US005522552A

United States Patent [19]

Liu et al.

[11] Patent Number: 5,522,552

[45] Date of Patent: Jun. 4, 1996

[54] WATER PLAY TOY

[75] Inventors: Dexter C. Liu, Portsmouth, R.I.; Douglas Melville, Simsbury; Paul Santarsiero, Avon, both of Conn.

[73] Assignee: LCD International, L.L.C., Newport, R.I.

[21] Appl. No.: 319,372

[22] Filed: Oct. 6, 1994

[51] Int. Cl.[6] ..... B05B 17/00

[52] U.S. Cl. ..... 239/583; 239/29.5

[58] Field of Search ..... 137/636; 239/211, 239/577, 578, 29.5, 562; 4/615

[56] References Cited

U.S. PATENT DOCUMENTS

| | | | |
|---|---|---|---|
| 1,064,540 | 6/1913 | Regar | 239/29.5 X |
| 2,275,963 | 3/1942 | Herman et al. | 137/636 X |
| 2,456,703 | 12/1948 | Hatchette | 4/145 |
| 2,689,151 | 9/1954 | Manning | 239/562 X |
| 2,829,379 | 4/1958 | McGee | 4/145 |
| 3,170,171 | 2/1965 | Mayhew et al. | 4/145 |
| 3,188,011 | 6/1965 | Ternullo | 239/578 |
| 4,205,785 | 6/1980 | Stanley | 239/17 |
| 4,526,366 | 7/1985 | Kenoun | 273/454 |
| 5,173,972 | 12/1992 | Goodman | 4/494 |

FOREIGN PATENT DOCUMENTS

| | | | |
|---|---|---|---|
| 2062799 | 6/1972 | Germany | 137/636 |

*Primary Examiner*—Kevin P. Weldon

*Attorney, Agent, or Firm*—Panitch Schwarze Jacobs & Nadel

[57] ABSTRACT

A water play toy includes a base and a platform pivotally secured over the base so as to be stepped on and pivoted. Several pairs of valves and nozzles are provided around the outer periphery of the toy between the platform and base with each valve positioned to be contacted by and depressed by the platform as the platform pivots onto such valve. Four spaced apart pivot members define eight primary axes over which the platform will pivot to open one, two or three of the adjoining valves at the same time. When the platform is stepped on within an area surrounded by the pivot members and with sufficient force, the platform is depressed vertically and all four valves are depressed and open. A simultaneous depression of all valves can be prevented by supporting the platform directly on the pivot members before activation.

20 Claims, 4 Drawing Sheets

WATER PLAY TOY

FIELD OF THE INVENTION

The invention relates to toys and, in particular to sprinkling outdoor water play toys.

BACKGROUND

Children have long used basic water sprinkling implements such as garden hoses with hose nozzles and lawn sprinklers as a form of outdoor play in warm weather. The spray patterns provided by such devices are generally fixed or regular and repeated. While water spray may be intrinsically entertaining to the children, children are likely to become bored from the predictability of such devices in a short time. Moreover, such devices are non-interactive. Most operate continuously in the same way regardless of anything the child does.

A few attempts have been made in the past to offer some variety. For example, U.S. Pat. No. 3,170,171 discloses a shower hoop for outdoor play in which an oversized hoop 3 is provided to loop over a base 2 having a pair of ramp surfaces 7 and 8, which lead through the loop.

U.S. Pat. No. 4,205,785 discloses another sprinkler spray toy which includes a base 12 having an upward facing nozzle 16 and a generally conically-shaped deflector 14, which can be placed upon the base covering the nozzle. Water passes uninterruptedly through the nozzle, upwardly into the open conical bottom of the deflector. The force of the water lifts the deflector into the air where it balances on the head of the water stream. The deflector can be formed as a combined impeller/sprinkler. The deflector is rotated by the water column while at the same time spraying water outwardly in a circular pattern.

U.S. Pat. No. 4,526,366 discloses an electronic water ejecting game which includes a base (12), a cover (14), a plurality of nozzles (40) and a like plurality of electrically actuated valves (V), which fluidly couple each nozzle to a central water coupling (48). The game has four player stations, each including, in addition to one of the spray nozzles, a connected valve switch (S1–S4) and light (L1–L4). The valves, lights and switches are all coupled together through an electronic cabinet (26), which is located on the base beneath the cover, and which includes a processor for responding to various switched depressions to determine which valve is to be actuated and which light is to be illuminated. Game play is controlled through the processor, which determines through a probability algorithm, which valve is to be operated in response to any switch depression or multiple switch depressions. The device provides warning through the light to the player whose valve is selected for actuation and provides a momentary time period for that player to depress his own switch to restart the process so as to select another valve for actuation. The device requires buttons on the surface of the cover to be hand actuated, necessitating the players to be huddled around the device. It further requires the provision of an AC power supply which further adds to the cost and may be dangerous in combination with water and children. Lastly, the water supply is provided through the bottom of the base suggesting that the base must be elevated off the ground and an opening provided in the supporting surface to permit a water connection into the bottom of the base of the device.

It would be very desirable to provide an interactive water play toy which can be made immediately available for use outdoors merely by coupling the toy with a conventional water source such as an ordinary garden hose and which does not require the provision of an AC electrical source and the potential hazards which can accompany the use of such an electrical source around water.

SUMMARY OF THE INVENTION

On one aspect, the invention is a water play toy comprising: a base; a platform supported on the base so as to at least pivot on the base with respect to any one of plurality of pivot axes extending transversely to one another; a hose coupling on one of the platform and the base; at least one nozzle on one of the platform and the base; and at least one valve fluidly coupled between the at least one nozzle and the hose coupling, the valve having at least open and closed states controlled by a movable actuator and the valve being positioned on one of the platform and the base so that the actuator can be moved by a remaining one of the platform and the base to change the state of the valve, at least when the platform is pivoted sufficiently on the base toward the actuator.

In another aspect, the invention is a water play toy comprising: a base; a platform supported on the base for at least pivotal movement with respect to any of a plurality of pivot axes extending in different directions to one another; a hose coupling extended from at least one of the base and the plaform; and a plurality of water nozzles, each nozzle being fluidly coupled with the hose coupling and being located on one of the base and the platform so as to discharge water at least upwardly above the toy and so that the pivotal movement of the platform on the base influences the discharge of water among the plurality of nozzles.

BRIEF DESCRIPTION OF THE DRAWINGS

The foregoing summary, as well as the following detailed description of presently preferred embodiments of the invention will be better understood when read in conjunction with the appended drawings. It should be understood, however, that this invention is not limited to the precise arrangements illustrated. In the drawings, which are all diagrammatic.

DETAILED DESCRIPTION OF PREFERRED EMBODIMENTS

Figure 1:
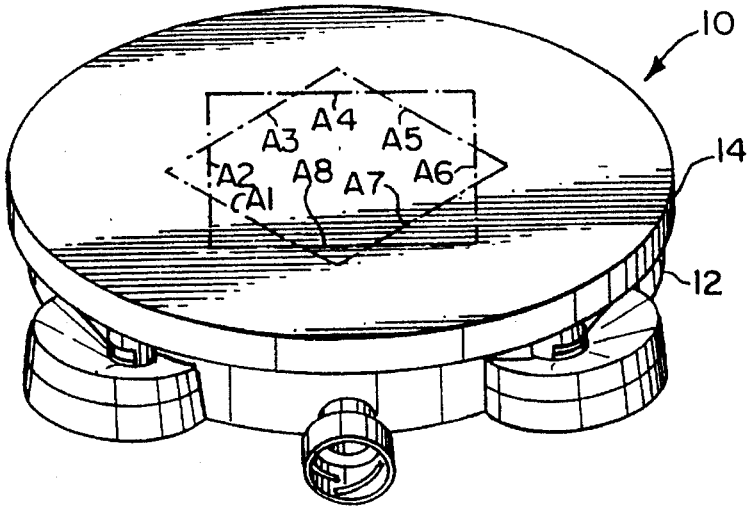
FIG. 1 is a perspective view of a presently preferred embodiment water play toy of the present invention.

Certain terminology is used in the following description for convenience only and is not limiting. The words "inwardly" and "outwardly" refer to directions towards and away from, respectively, the geometric center of the device or designated parts thereof. The words "right", "left", "lower", and "upper" designate directions in the drawings to which reference is made. Referring now to the drawings, in which like reference numerals identify like elements throughout the several views, there is shown in FIG. 1 a water play toy according to the present invention indicated generally at 10. The device seen in FIG. 1 includes a base indicated generally at 12 and a platform indicated generally at 14 supported on the base so as to pivot on the base 12 with respect to at least a plurality of different axes extending transversely to one another. The eight primary pivot axes are indicated A1–A8 in FIG. 2, on platform 14. Primary axes are those axes over which the platform 14 most readily and most often pivots. Depending upon the construction and wear of a particular toy 10, the platform 14 may pivot over additional axes transverse to one another and the eight primary axes. It will be appreciated that of the eight primary axes only four are mutually transverse to one another. The remaining four axes are parallel to the first four.

Figure 2:
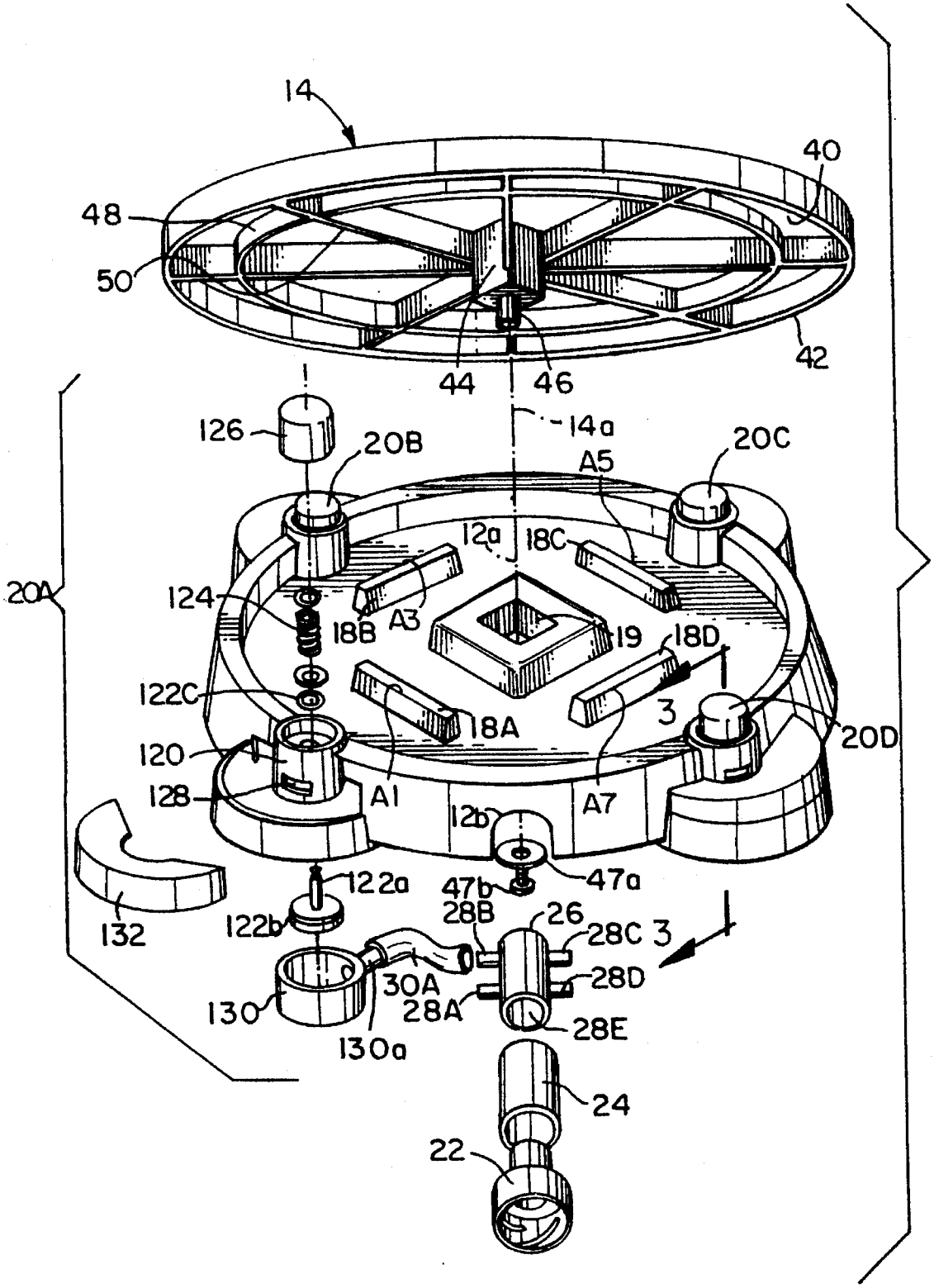
FIG. 2 is a partially exploded view of the toy of FIG. 1.

As is best seen in FIG. 2, the base 12 is preferably provided with a large central opening 16 on its upper side. Preferably provided within the large central opening 16 are a plurality of pivot members, four upwardly projecting, prismatically-shaped pivot members being indicated at 18A through 18D. Pivot members 18A–18D symmetrically surround a central well 19 having raised side walls. Also provided are a plurality of valves and a plurality of nozzles, four preferably identical valve and nozzle assemblies, one associated with each pivot member 18A through 18A, being indicated and correspondingly numbered 20A through 20D.

Figure 3:
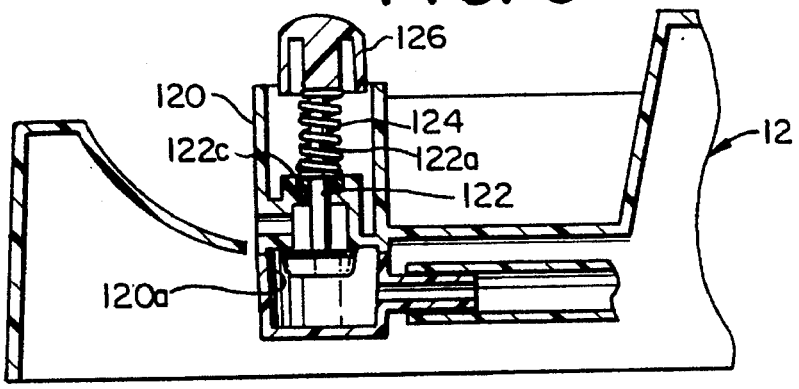
FIG. 3 is an elevational cross-sectional view taken along the lines of 3—3 of FIG. 2.
Figure 4:
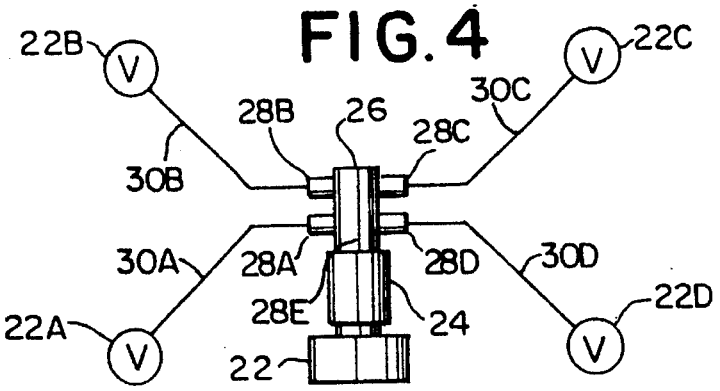
FIG. 4 is a schematic view of the water distribution conduits of the toy of FIG. 1.

More details of the water delivery system are shown in FIGS. 3 and 4. The water delivery system preferably includes, in addition to each of the valve and nozzle assemblies 20A through 20D, a standard female threaded hose coupling 22 with a manifold 26 and a conduit 24, which connects the female hose coupling 22 with the manifold 26 through inlet port 26E. The female hose coupling 22 extends through a cut-out 12*b* and is clamped with the conduit against opposing sides of a wall of the base 12. Manifold 26 also has four outlet ports 28A through 28D. Each outlet port 28A–28D is fluidly coupled to a respective one of the nozzle and valve assemblies 20A through 20D via conduits 30A through 30D, respectively (see FIG. 4).

Referring to FIGS. 2 and 3, each shows details of one of the four, identical valve and nozzle assemblies 20A through 20D. Each assembly preferably includes a tubular housing 120 formed in the base 12. A seat 120*a* is provided on the lower end of the housing 120 to mate with a valve 122. A spring 124 is mounted over a stem 122*a* of the valve 122 and biases the valve head 122*b* against the seat 120*a* and an O-ring seal 122*c* against the opposite side of the tubular housing 120. An actuator is provided in the form of a cover member 126 mounted directly on the upper end of the valve stem 122*a* so as to protrude upwardly from the base 12 and outwardly from the tubular housing 120 and the valve and nozzle assembly. If desired, the upper end of the valve stem could be used directly as an actuator and cover member 126 deleted or any of an innumerable variety of indirect couplings provided between another type actuator and valve to permit movement of the valve directly or indirectly through movement of the exposed actuator. A nozzle 128 is provided in the form of a slot through a side of the housing 120 which is exposed on a side of the base 12. Slot 128 is downstream from the valve 122 and is fluidly coupled through the housing 120 to the valve 122. Valve 122 is fluidly coupled to one of the conduits 30A–D through a chamber defining member 130 having an inlet 130*a* receiving one of the conduits 30A–D extending from manifold 26. When the valve 122 is opened (head 122*b* unseated from seat 102*a*) water flows under pressure from the chamber defined by member 130 through the opening in the seat through which the valve stem 122*a* passes to the nozzle 128. In this way, the valve 122 and nozzle 128 are each fluidly coupled to the threaded hose coupling 122. Nozzle 128 is configured (sized and shaped) to accelerate the water it discharges so that it will be projected at least a reasonable distance from the toy, even when several valves are simultaneously activated. Preferably, a cupped deflector 132 is provided opposite the nozzle 128 which is oriented to discharge onto the deflector 132 so that the water in discharged a desired direction or directions, preferably up above or up and radially outwardly away from the toy. Deflector 132 may be formed in one piece with the base or separately formed and mounted to the base as shown.

Figure 5:
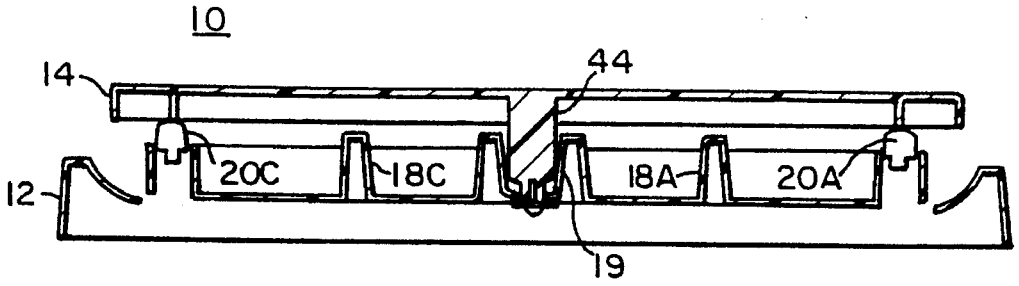
FIG. 5 is a simplified, cross-sectional elevational view of the toy with the platform in the normal, unloaded position.
Figure 6:
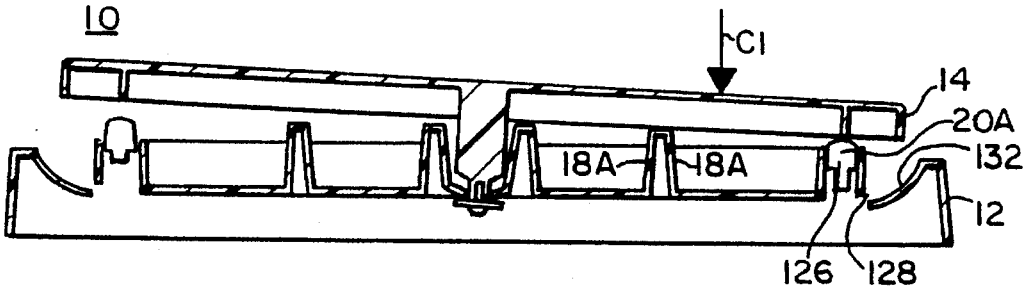
FIG. 6 and 7 are simplified, cross-sectional elevational views of the toy illustrating possible movements of the platform under load on the base to actuate one or more of the valves.
Figure 7:
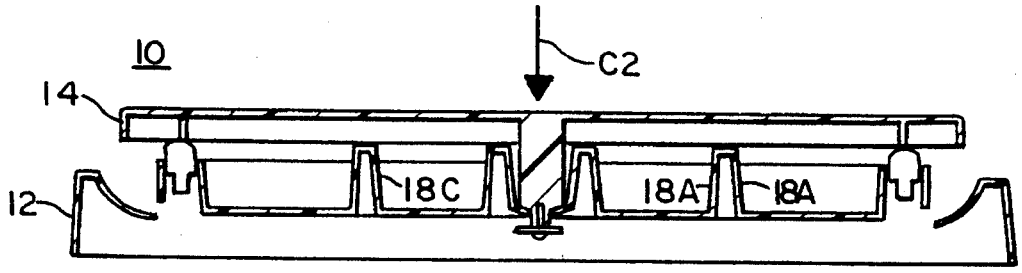

Referring again to FIG. 2, platform 14 preferably has a circular top panel 40, the bottom side of which is visible in the figure supporting a skirt 42 which extends downwardly and circumferentially from the outer periphery of the top panel 40. Platform 14 preferably further includes a center post 44 which, in turn, supports a downwardly extending hollow shaft 46. .Also supported from the top panel 40 are a downwardly extending circular rib 48 and a plurality of downwardly extending radial ribs 50, eight of which are indicated and which are preferably uniformly angularly positioned around the center 14*a* of the platform 14. Radial ribs 50 intersect the circular rib 48 and skirt 42 and together provide load bearing mechanical strength to the platform 14. Circular rib 48 is positioned to extend over the center of each actuator 128 of each of the valve and nozzle assemblies 20A–20D. This is best seen in FIG. 5–7. In addition, the center post 44 is received in the well 19 of base 12 and is keyed with the well, for example by the well 19 and center post 44 being of similar polygonal shape, to at least substantially prevent rotation of the platform 14 with respect to the base 12. Preferably, the hollow shaft 46 passes through an opening at the bottom of the well 19 and is loosely movably secured to the base 12 by stop washer 47*a* and threaded fastener 47*b* received in shaft 46. The side walls of the well 19 are preferably inwardly tapered to define tapering gaps between the well 19 and center post 44. These gaps permit downward as well as pivoting movement of the center post 44 in the well 19 and thus define at least part of a pivotal coupling between the platform 14 and the base 12. Of course, the cover 14 may be pivotally coupled to the base 12 in other ways.

The pivotal mounting of the platform 14 on the base 12, including the coupling through post 44 and well 19, is best illustrated in FIGS. 5 and 6. Platform 14 can be permitted to simply rest upon the pivot members 18A–18D or, more preferably as shown in FIG. 5, upon the spring biased cover members 126 of each of the valve and nozzle assemblies 20A–20D. In the latter case, the platform 14 is spring supported through the springs 12 of each valve and nozzle assembly 20A–20D.

Referring back to FIG. 2, the pivot members 18A–18D are preferably centrally located to define sides of a square or alternate sides of an octagon. Each pivot member 18A–18D is preferably located midway the center 12*a* of the base 12 and the cover member 126 of the closest adjoining valve and nozzle assembly 20A–20D. Each of the sides of the octagon defined by the pivot members 18A–18D defines one of the eight primary pivot axes A1–A8.

Operation of the toy 10 will now be described. Initially, a conventional garden hose (not depicted) is coupled to the threaded hose coupling 22 and the base 12 is placed upon preferably level ground or another level support surface. Water is supplied through the hose and passes through the hose coupling 22, the conduit 24, manifold 26, outlet ports 26A–26D and individual conduits 30A–30D to the chambers defined by the members 130 of each valve and nozzle assembly 20A–20D. The valve 122 of each valve and nozzle assembly 20A–20D is biased closed by its spring member 124 and the toy 10 sits in the nominal position indicated in FIGS. 4 and 5 with all valves closed.

When the platform 14 is stepped on or a force is otherwise downwardly applied to the platform 14 sufficiently great to overcome the bias of spring(s) 124, the platform 14 will move with respect to the base 12. When the center C1 of the weight or other force being directly applied to the platform 14 lies outside the octagon defined by the pivot members 18A–18D, the platform 14 will pivot on the base 12 to contact the cover member 126 of only one or a subset of less than all of the valve and nozzle assemblies 20A–20D. As illustrated in FIG. 6, for example, the center C1 of the weight or other force may be applied to the platform 14 radially outwardly from the pivot member 18A. Platform 14 pivots in well 19 and over pivot member 18A about pivot axis A1 until cover member 126 is fully depressed and the valve of the proximal valve and nozzle assembly 20A is fully opened. Water is released only through the nozzle slot 128 of that assembly 20A and is directed upwardly and/or outwardly by the associated cup deflector 132. If the weight or other force applied radially of the pivot member 18A and is applied transversely to either side of the indicated radial platform rib 50, which extends across pivot member 18A, the platform 14 will also tend to roll around that rib 50. When the weight is sufficiently great or located sufficiently transversely to either side of indicated rib 50, the platform 14 will tend to pivot along a pivot axis extending through the adjoining proximal ends of the adjoining pivot member pairs 18A/18B or 18A/18D, (i.e., pivot axis A2 or A8) and one or the other of the adjoining nozzle and valve assemblies 20B and 20D will also be actuated with assembly 20A.

If the center C2 of the weight or other force applied to the platform lies within the octagon defined by the pivot members 18A–18D, the platform 14 will move generally straight down as shown in FIG. 7, depressing the cover member 126 of each of the valve and nozzle assemblies 20A–20D deflecting each of the originally closed valves 122 downwardly, opening those valves and permitting the pressurized water in each chamber 130 to enter the tubular housing 120 and pass through the nozzle slot 128. Water exiting each nozzle slot 128 strikes the deflector 132 positioned radially outwardly from each nozzle slot 128 and is directed upward and/or outwardly by such deflector.

The ability of the device to pivot about different axes which are transverse to one another enables different valve and nozzle assemblies 20A–20D to be individually activated, activated in adjoining subsets or activated all together and thereby adds to the enhanced entertainment value of the toy 10 in contrast to a toy which might activate all valve and nozzle assemblies all of the time. It will be appreciated that each valve and nozzle assembly 20A–20D will be activated essentially only when the platform 14 pivots sufficiently about the primary pivot axis most proximal to the assembly; i.e., A1, A3, A5 or A7. Each nozzle assembly 20A–20D will further be activated when the platform 14 pivots sufficiently about either primary pivot axis immediately adjoining the most proximal pivot axis. That is, assembly 20A will further actuate when the platform 14 is pivoted sufficiently about either primary axis A2 or A8, which adjoin primary axis A1, the primary axis most proximal to assembly 20A. The assembly 20A will not be activated when the platform 14 is pivoted about any of the other primary pivot axes A3–A7.

Figure 8:
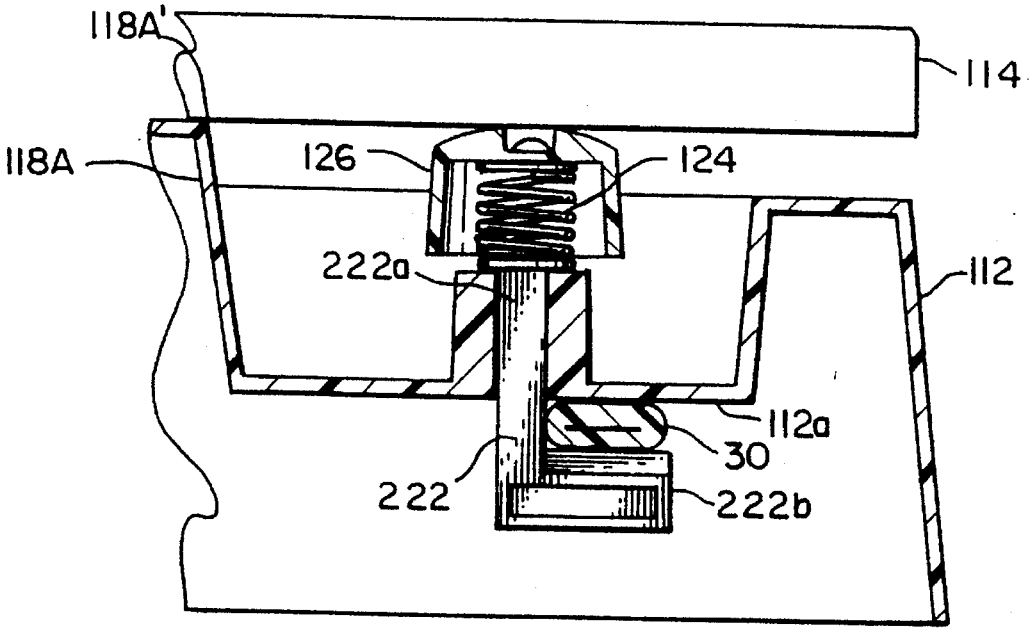
FIG. 8 is an elevational, partially broken away view of an alternate valve embodiment.
Figure 9:
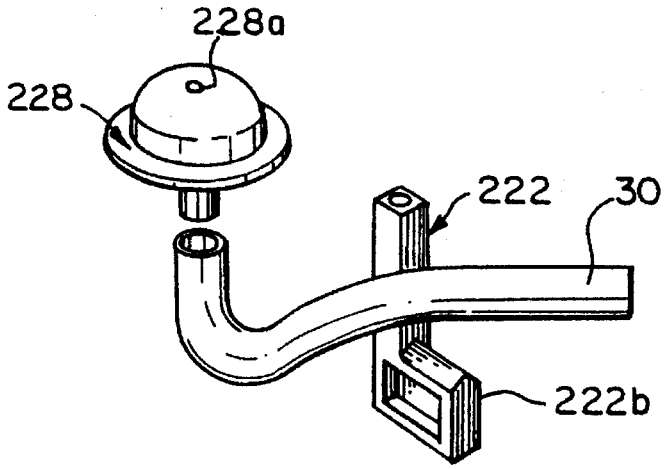
FIG. 9 depicts in a nozzle used with the valve of FIG. 8.

FIGS. 8 and 9 depict alternate valve and nozzle components as well as a slightly modified toy indicated generally at 100. Toy 100 again includes a base 112 substantially like the base 12 except as it has been modified as noted below and a platform 114, which might be identical to platform 14 or of another configuration as desired. One valve of a plurality of preferably identical valves of toy 100 is indicated generally at 222. Valve 222 again includes a stem **222*a* extending through the upper surface of the base 112, which supports a head 222*b* beneath the lower surface of the base 112. Again, a coil spring 124 between washers (unnumbered) and an actuator 126 in the form of a cover member are again provided. Spring 124 biases valve head 222*b* upwardly against the lower side 112*a* of the base 112, which forms a seat for the valve 122, to compress and close a flexible conduit member 30 extending from a water source such as a threaded female hose coupling and manifold (neither depicted) to a nozzle 228 having an outlet orifice 228*a*. The nozzle 228 might be formed into the base or might be a separate assembly as indicated mounted on the side of the base 112 in an appropriate holding ring (not depicted) molded into the side of the base. In this embodiment 100, nozzle opening 228*a* is preferably located at the top of the nozzle 228 to spray directly upwardly. Toy 100 creates a fountain effect with one to a plurality of vertical water columns, depending upon how many of the plurality of valves 222 are activated. The water columns are intended to be directed upwardly at anyone standing on the platform. Accordingly, the nozzles 228 and/or orifices 228*a* may be located to direct the water column up and also somewhat radially inwardly so as to cross over the platform at some location above the platform. Of course, the nozzles 228 and/or orifices 228*a* could also be positioned to direct water columns and/or sprays up and radially outwardly like toy 10 to also wet or to only wet people standing around the device 100**.

Unlike the first embodiment, the platform 114 of toy 100 is nominally supported on each of a plurality of pivot members extending upwardly from the base 112, one pivot member 118A being indicated. As platform 114 pivots over the radially outer corner 118A' of the pivot member 118A, it contacts and depresses actuator 126, forcing valve member 222 downward and releasing the compression of head **222*b* against flexible conduit 30 to allow the pressurized water upstream from the valve 222 to pass downstream to the nozzle housing 228**.

Still other, presently less preferred embodiments are possible. For example, it should be apparent from the disclosure that a centrally located bias member can be combined with radially outwardly positioned pivot members and that outwardly positioned bias members can be combined with a centrally located pivot member or members. It is further believed possible to suitably operate a device with a single bias member or a plurality of bias members and without any fixed pivot member or a center post and well. The single bias member or plurality of bias members would effectively act as a pivot or pivots permitting the platform to tip in a multitude of ways in which the tipping movement would define at least one and typically a multitude of time sequential pivot axes as the platform changes in both height and pitch where no fixed pivot member is provided.

For example, a compression coil spring can be secured to the bottom side of a platform and/or upper side of a base at the center of both the platform and base to form a direct, pivotal coupling between the platform and the base. The coil spring would elevate the platform and can be used in place of the well 19 and center post 44 and pivot members 18A–18D to permit pivoting of the platform over any of virtually an infinite variety of axes extending transversely through compression coil spring. If such a compression coil spring were provided, it is suggested that a central pivot member, preferably one having a radiused or otherwise curved contact surface further be provided extending downwardly from the center of the platform towards the base or upwardly from the center of the base towards the platform within the compression spring (again neither depicted). The central pivot member can assist in supporting the weight of anyone stepping on the platform and, because of its central location, can foster the pivoting movement of the platform over the base.

In addition to the preferred pivot members and bias members disclosed, it will be appreciated that a variety of other configurations can be employed. For example, while all bias members disclosed thus far have been coil springs, it would be possible to utilize any of a variety of conventional, known bias members including other types of springs, elastomer members and even the fluid pressure from the water entering the device to bias the platform back to a predetermined initial state in which none of the valves of the plurality of assemblies 20A–20D are activated.

While the preferred embodiments disclosed mount the valves, nozzles and hose coupling to the base, any or all could be mounted to or supported from the platform, with each valve or its actuator positioned between the platform and base to be moved when the platform pivots on the base over the appropriate pivot axis or axes thereby opening the valve.

While four straight, uniformly sized, shaped and positioned pivot members 18A–18D have been disclosed as preferred, it should be appreciated that if pivot members are provided at all, they are not limited to that arrangement. In particular, segmented pivot members, straight and/or curved, less or more than four in number can be provided, uniformly or differently shaped, uniformly or asymmetrically positioned or spaced. Furthermore, continuous pivoting structures can be provided, if desired, extending entirely and unbrokenly around the center of the base (or platform), fully polygonal (symmetric or asymmetric), fully curved (symmetric or asymmetric) or combined curved and straight sections, continuously connected end to end.

While a movable engagement between the platform 14 and base 12 has been described thus far in terms of a preferred coupling of the platform to the base through the post 44, shaft 46, well 19 and fastener 47, it should be appreciated that the platform and base may be coupled together in other ways for at least pivotal movement of the platform with respect to the base. For example, the platform may be spring supported on the base and a retaining ring secured with the circumferential perimeter of the base so as to overlap a circumferential portion of the platform and thereby retain the platform on the base and yet within the base.

It should be further be appreciated that the operation of the device as disclosed might be reversed. That is, instead of the valves being in a normally off or closed state as in the disclosed preferred embodiments, the valves could be configured and mounted to be in a normally on state and closed as a result of pivotal movement of the platform. What is significant to the invention is that the state of each of the valves is influenced, more specifically controlled and varied, at least through pivotal movement of the platform on the base.

It will further be appreciated that in its simplest form, valves may be eliminated entirely from the toy and merely a plurality of nozzles provided located on at least one of the base and the platform so as to discharge water at least upwardly or upwardly and outwardly above the toy. Again, what is important with respect to the present invention is that the nozzles are located so that the pivotal movement of the platform on the base directly influences the discharge of water among the plurality of nozzles. So, for example, the platform could be configured to interrupt the upward discharge of water from each of the nozzles in the normal, unloaded state of the platform and yet pivot out of the discharge of one or a subset of all of the nozzles when the platform pivoted sufficiently on the base about a horizontal axis. Alternatively, the platform might be designed with small openings concentrically aligned with the discharge of each nozzle when the platform is unloaded so as to permit the unimpeded discharge of water through the openings until the platform is loaded and pivoted, moving the openings out of alignment and interrupting the discharge of one or more of the nozzles with portions of the pivoted platform.

While preferred embodiments have been disclosed and various alternate embodiments and modifications thereto suggested, the present invention may be embodied in other specific forms without departing from its spirit or central attributes. Accordingly, reference should be made to the foregoing claims rather than to the foregoing specification and attached drawings as indicating the scope of the invention.

What is claimed is:

1. A water play toy comprising:

a base;

a platform supported on the base so as to at least pivot on the base with respect to a plurality of pivot axes extending transversely to one another;

a hose coupling on one of the platform and the base;

at least one nozzle on one of the platform and the base; and at least one valve fluidly coupled between the at least one nozzle and the hose coupling, the valve having at least open and closed states controlled by a movable actuator and the valve being positioned on one of the platform and the base so that the actuator can be moved by a remaining one of the platform and base to change the state of the valve, at least when the platform is pivoted sufficiently on the base toward the actuator.

2. The toy of claim 1 further comprising at least one pivot member extending from one of the platform and the base towards the other of the platform and the base, the platform having an exposed top surface and the platform pivoting over the pivot member only when sufficiently loaded on certain portions of the exposed top surface.

3. The toy of claim 1 further comprising a plurality of pivot members, the plurality of pivot members being substantially uniformly angularly spaced around a center of at least one of the platform and the base.

4. The toy of claim 3 comprising a plurality of valves including the one valve, the plurality of valves being equal to the plurality of pivot members.

5. The toy of claim 4 wherein each valve includes an actuator and each pivot member is centrally located between the actuator of one of the plurality of valves and a center of the platform.

6. The toy of claim 2 further comprising a post projecting downwardly from the platform and a well in the base receiving the post, the post being secured to the base through the well for at least limited vertical and pivotal movement of the platform with respect to the base.

7. The toy of claim 1 further comprising a plurality of valves including the one valve, and a plurality of nozzles including the one nozzle, the plurality of nozzles being equal to the plurality of valves, the one nozzle being fluidly coupled to the hose coupling through only the one valve of the plurality of valves.

8. The toy of claim 1 wherein the platform is supported by the actuator before any pivotal movement of the platform and further comprising a bias member between the actuator and one of the platform and the base, the bias member supporting the platform through the actuator at least before the platform is pivoted.

9. The toy of claim 1 further comprising a chamber fluidly coupled with the hose coupling, a seat for the valve within the chamber and a passageway fluidly coupling the chamber and the nozzle through the valve seat.

10. The toy of claim 1 further comprising a flexible conduit coupling the nozzle with the hose coupling through the valve, the valve including a head on one side of the flexible conduit and further comprising a valve seat on an opposing side of the conduit from the head of the valve.

11. A water play toy of claim 1 wherein the platform is keyed with the base so as to at least limit rotation of the platform about a vertical axis through the base.

12. A water play toy comprising:

a base;

a platform supported on the base for at least pivotal movement with respect to any of a plurality of pivot axes extending in different directions to one another;

a hose connector extended from at least one of the base and the platform; and a plurality of water nozzles, each nozzle being fluidly coupled with the hose connector and being located on at least one of the base and the platform so as to discharge water at least upwardly above the platform and so that the pivotal movement of the platform on the base influences the discharge of water from the plurality of nozzles.

13. The toy of claim 12 further comprising:

a plurality of valves, each valve being supported from at least one of the platform and the base, each valve being fluidly coupled between the hose connection and at least one of the nozzles, each valve including a movable actuator, and each actuator being positioned for movement by one of the platform and the base to actuate the valve at least when the platform pivots sufficiently with respect to the base about a subset of the pivot axes, the subset of pivot axes being less than all of the plurality of pivot axes.

14. The toy of claim 12 further comprising a plurality of valves equal to the plurality of water nozzles, each water nozzle being fluidly coupled to the hose connector through a different one of the plurality of valves.

15. The toy of claim 14 wherein the plurality of valves are coupled with a plurality of valve actuators and wherein the platform is supported by the plurality of valve actuators before any pivotal movement of the platform occurs.

16. The toy of claim 12 further comprising a chamber fluidly coupled between the hose connector and at least one of the plurality of water nozzles, a valve movably located within the chamber, a seat within the chamber for the valve, and a passageway fluidly coupling the chamber and at least one of the plurality of water nozzles through the seat.

17. The toy of claim 12 further comprising a flexible conduit coupling at least one of the plurality of water nozzles with the hose connector, a valve including a head on one side of the flexible conduit and a valve seat on opposing side of the flexible conduit from the head of the valve.

18. The toy of claim 12 wherein the platform is keyed with the base so as to at least limit rotation of the platform about a vertical axis through the base.

19. The toy of claim 12 wherein the hose connector is female threaded and is exposed on the toy to permit hose connection and disconnection.

20. The toy of claim 1 wherein the hose coupling is female threaded and extended from the one of the platform and the base to permit manual hose connection and disconnection.

* * * * *